US006992638B2

(12) United States Patent
du Toit et al.

(10) Patent No.: US 6,992,638 B2
(45) Date of Patent: Jan. 31, 2006

(54) HIGH GAIN, STEERABLE MULTIPLE BEAM ANTENNA SYSTEM

(75) Inventors: Cornelis Frederick du Toit, Ellicott City, MD (US); Shuguang Chen, Ellicott City, MD (US); Ernest P. Ekleman, Damascus, MD (US)

(73) Assignee: Paratek Microwave, Inc., Columbia, MD (US)

( * ) Notice: Subject to any disclaimer, the term of this patent is extended or adjusted under 35 U.S.C. 154(b) by 18 days.

(21) Appl. No.: 10/811,706

(22) Filed: Mar. 29, 2004

(65) Prior Publication Data

US 2005/0068249 A1 Mar. 31, 2005

Related U.S. Application Data

(63) Continuation-in-part of application No. 10/673,033, filed on Sep. 27, 2003, now abandoned.

(51) Int. Cl.
*H01Q 13/00* (2006.01)

(52) U.S. Cl. ..... 343/776; 343/762; 343/711

(58) Field of Classification Search ..... 343/757, 343/762, 772, 776, 853, 771
See application file for complete search history.

(56) References Cited

U.S. PATENT DOCUMENTS

| | | | | |
|---|---|---|---|---|
| 5,312,790 | A | 5/1994 | Sengupta et al. | 501/137 |
| 5,427,988 | A | 6/1995 | Sengupta et al. | 501/137 |
| 5,486,491 | A | 1/1996 | Sengupta et al. | 501/137 |
| 5,593,495 | A | 1/1997 | Masuda et al. | 117/4 |
| 5,612,702 | A * | 3/1997 | Kinsey | 342/427 |
| 5,635,433 | A | 6/1997 | Sengupta | 501/137 |
| 5,635,434 | A | 6/1997 | Sengupta | 501/138 |
| 5,640,042 | A | 6/1997 | Koscica et al. | 257/595 |
| 5,693,429 | A | 12/1997 | Sengupat et al. | 428/699 |
| 5,694,134 | A | 12/1997 | Barnes | 343/700 |
| 5,766,697 | A | 6/1998 | Sengupta et al. | 427/585 |
| 5,830,591 | A | 11/1998 | Sengupta et al. | 428/701 |
| 5,846,893 | A | 12/1998 | Sengupta et al. | 501/137 |
| 5,886,867 | A | 3/1999 | Chivukula et al. | 361/311 |
| 5,990,766 | A | 11/1999 | Zhang et al. | 333/205 |
| 6,074,971 | A | 6/2000 | Chiu et al. | 501/139 |
| 6,366,238 | B1 * | 4/2002 | DeMore et al. | 342/368 |
| 6,377,142 | B1 | 4/2002 | Chiu et al. | 333/238 |
| 6,377,217 | B1 | 4/2002 | Zhu et al. | 343/700 |
| 6,377,440 | B1 | 4/2002 | Zhu et al. | 361/311 |
| 6,404,614 | B1 | 6/2002 | Zhu et al. | 361/277 |
| 6,492,883 | B2 | 12/2002 | Liang et al. | 333/132 |
| 6,514,895 | B1 | 2/2003 | Chiu et al. | 501/137 |
| 6,525,630 | B1 | 2/2003 | Zhu et al. | 333/205 |
| 6,531,936 | B1 | 3/2003 | Chiu et al. | 333/164 |
| 6,535,076 | B2 | 3/2003 | Partridge et al. | 333/17.1 |

(Continued)

OTHER PUBLICATIONS

S.Chen, C. du Toit, K. Hersey, D. Pao, V. Karasack, J. Patel, M. Ramesh, C. Sui, E. Ekelman, Azimuth Scanning, Ka-Band Phased Array Antenna, Paratek Microwave, Inc.

*Primary Examiner*—Shih-Chao Chen
(74) *Attorney, Agent, or Firm*—William J. Tucker; James S. Finn

(57) ABSTRACT

A multi-beam antenna system is described herein that can be used in microwave frequency applications between 1 GHz and 100 GHz. The multi-beam antenna system covers four 90° sectors for full 360° coverage. Each 90° sector is covered with at least 1 narrow steerable transmit (TX) and 1 narrow steerable receive (RX) beam. The beams are steered in the azimuth dimension.

28 Claims, 8 Drawing Sheets

U.S. PATENT DOCUMENTS 6,538,603 B1 3/2003 Chen et al. ..... 342/372
6,556,102 B1 4/2003 Sengupta et al. ..... 333/161
6,590,468 B2 7/2003 du Toit et al. ..... 333/17.3
6,597,265 B2 7/2003 Liang et al. ..... 333/204
6,653,985 B2 * 11/2003 Sikina et al. ..... 343/853
6,781,554 B2 * 8/2004 Lee et al. ..... 343/771

* cited by examiner

Corporate feed structure

Centre-series feed structure

HIGH GAIN, STEERABLE MULTIPLE BEAM ANTENNA SYSTEM

CROSS REFERENCE TO RELATED PATENT APPLICATION

This application is a continuation-in-part application of U.S. patent application Ser. No. 10/673,033, filed Sep. 27, 2003, now abandon, which is incorporated by reference herein.

BACKGROUND OF THE INVENTION

In wireless communications efficient communications can be greatly facilitated by much improved and novel antenna systems. Thus, there is a long standing need in the wireless communications and antenna art for antennas that can provide high-gain, antennas that provide for multi-beams, and antennas that can provide 360 degree radiation.

BRIEF DESCRIPTION OF THE INVENTION

The present invention is a multi-beam antenna system that can be used in microwave frequency applications between 1 GHz and 100 GHz. The multi-beam antenna system covers four 90° sectors for full 360° coverage. Each 90° sector is covered with at least 1 narrow steerable transmit (TX) and 1 narrow steerable receive (RX) beam. The beams are steered in the azimuth dimension.

BRIEF DESCRIPTION OF THE DRAWINGS

A more complete understanding of the present invention may be had by reference to the following detailed description when taken in conjunction with the accompanying drawings wherein.

DETAILED DESCRIPTION OF THE DRAWINGS

Figure 1:
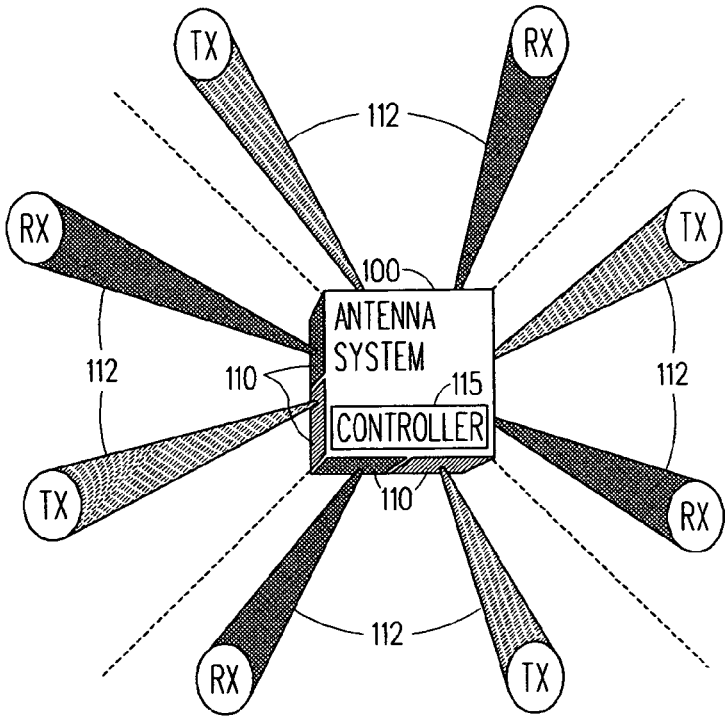
FIG. 1 is a plan view diagram that illustrates a multi-beam antenna system in accordance with the present invention.
Figure 8:
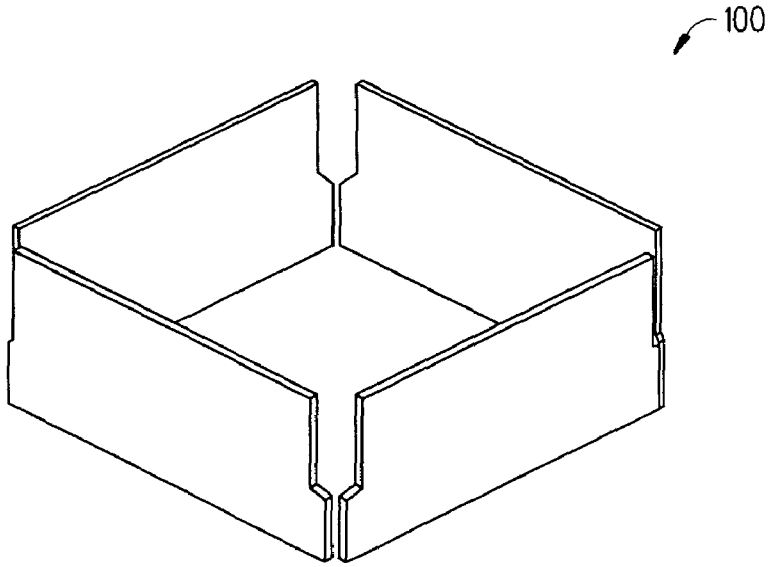
FIG. 8 is a diagram that illustrates one way to package the multi-beam antenna system shown in FIG. 1.
Figure 9A:
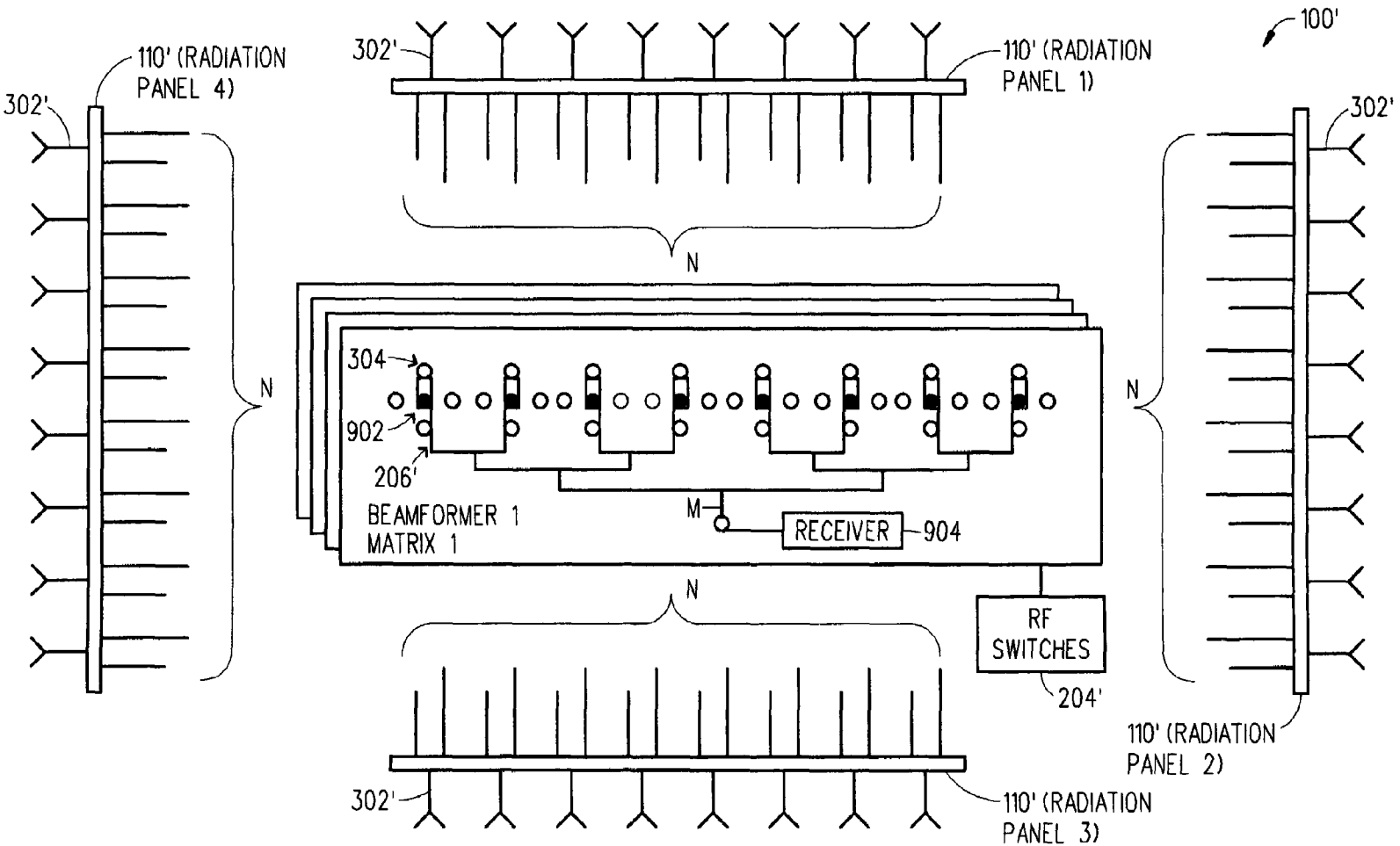
FIGS. 9A and 9B are diagrams of another embodiment of the multi-beam antenna system shown in FIG. 1.

The multi-beam antenna system 100 includes four pairs of independent TX (transmit) and RX (receive) apertures 110 that may be arranged into a square formation as shown in FIG. 1 (see also FIGS. 8 and 9). Each pair of TX and RX apertures 110 emits a pair of TX and RX radiation beams 112 that cover one 90° wide sector, so that the multi-beam antenna system 100 can cover the full 360° range.

Figure 2:
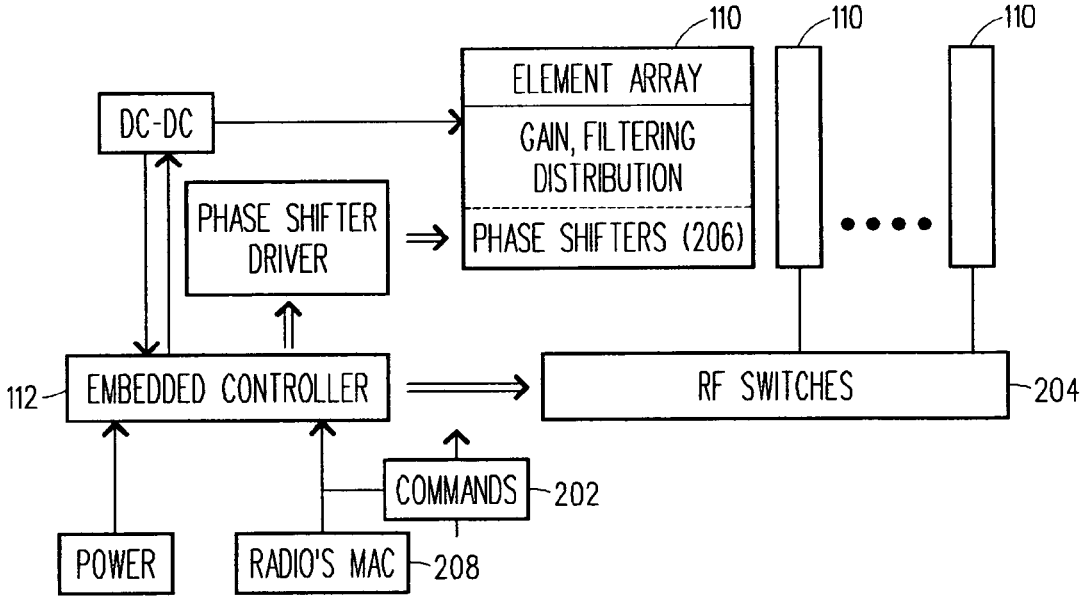
FIG. 2 is a diagram illustrating in greater detail one way a controller can be used to control the multi-beam antenna system shown in FIG. 1.

The multi-beam antenna system 100 also includes a controller 115 (e.g., embedded controller 115) shown in FIG. 2 that performs all of the tasks related to pointing the radiation beams 112. The controller 115 performs the following functions:

Receive and execute antenna commands 202

Control the RF switches 204.

Adjust the tunable phase shifters 206

In particular, the controller 115 receives the antenna commands 202 from a radio's media access controller (MAC) 208 and executes the commands 202 in order to point any of the eight radiation beams 112 to a specific azimuth setting. The radiation beam 112 pointing functions are carried out through the use of electronic RF switches 204 and phase shifters 206. The RF switches 204 are used to select a particular aperture 110 or antenna quadrant while the phase shifters 206 on each of the four sides of the multi-beam antenna system 100 are adjusted to achieve incremental steering of the radiation beams 112. Alternatively, the multi-beam antenna system 100 can be fed by four separate transceiver systems, allowing for four simultaneous RX beams 112 and four simultaneous TX beams 112.

Figure 3:
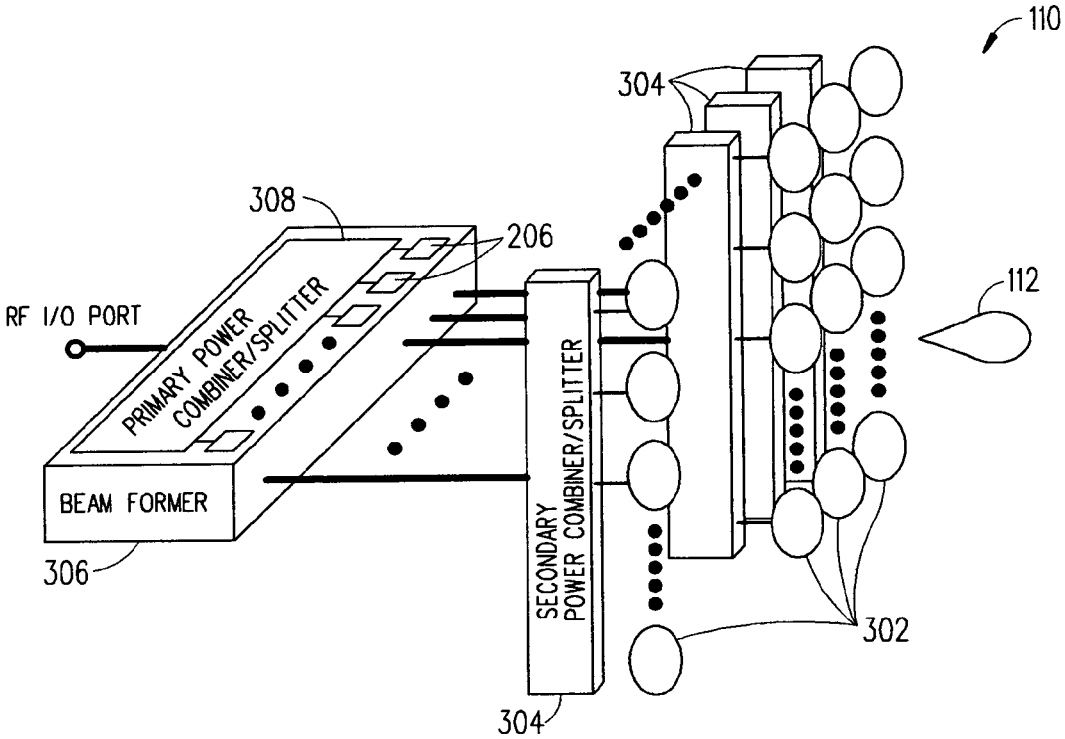
FIG. 3 is a diagram illustrating in greater detail the components of a single aperture that can be used within the multi-beam antenna system shown in FIG. 1.

Each TX and RX aperture 100 as shown in FIG. 3 includes multiple rows and columns of radiating elements 302. The radiating elements 302 in each column are connected together via microwave transmission lines in a column secondary power splitter 304 (in the RX aperture 100) or column secondary power combiner 304 (in the TX aperture 100). The secondary power splitter/combiners 304 are connected to a beam former 306 that steers the radiation beam 112 in one dimension, which in the preferred embodiment is the azimuth direction. Above 10 GHz, the transmission lines and/or secondary power combiners/splitters 304 are usually realized in waveguides to minimize loss, but microstrip or stripline transmission lines and power combiner/splitters can be used up to about 30 GHz. Waveguide transmission lines and power combiners/splitters can also be used below 10 GHz, but the structure can become quite bulky. Co-axial transmission lines are also practical below about 3 GHz. With the use of microstrip, striplines or co-axial lines, wide bandwidth corporate feed structures are easily realizable, such a structure is shown in FIG. 6A. Waveguide corporate feed structures are very bulky, requiring significant amounts of volume. For this reason, series fed waveguide structures are used instead when the operating bandwidth is narrow (less than 5% of the operating frequency), as shown in FIG. 6B. The series fed waveguide structure is used in the preferred embodiment of the primary power combiner/splitter 308 (see FIG. 4) and the secondary power combiners/splitters 304 (see FIG. 5).

Figure 4:
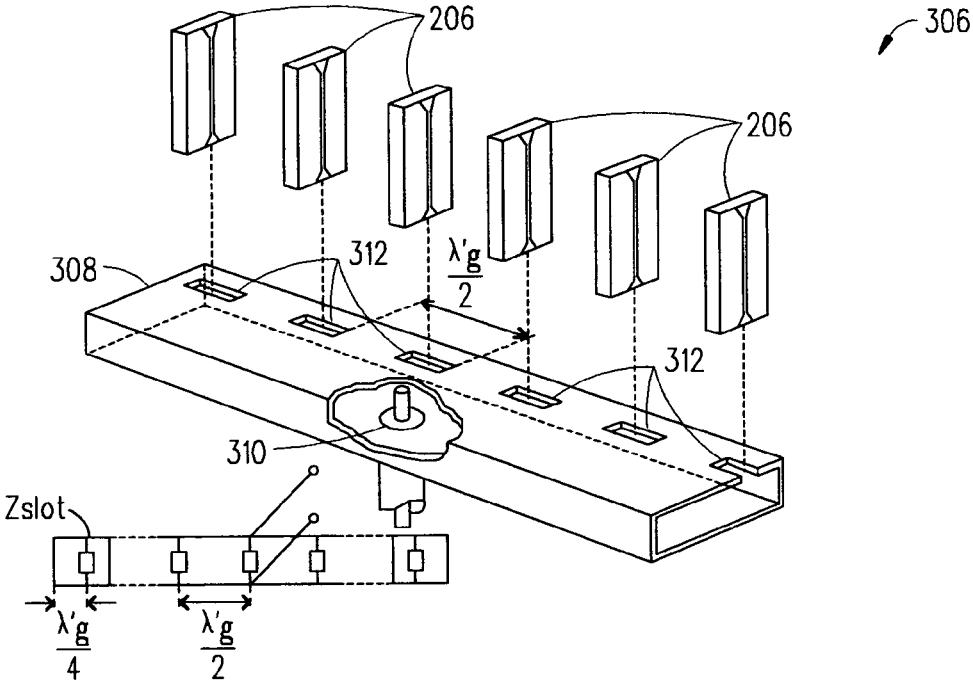
FIG. 4 is a diagram illustrating in greater detail the components of a beam former that can be used within the multi-beam antenna system shown in FIG. 1.

As shown in FIG. 4, the beam former 306 includes a primary power combiner/splitter 308 (e.g., centre fed waveguide 308) which distributes/collects power in a serial manner to/from the row of phase shifters 206. The phase shifters 206 in turn feed the column secondary power combiners/splitters 304 having the form of secondary waveguides fed at their respective centres, which finally distribute power again in a serial fashion to the radiating elements 302 (e.g., antenna elements 302) (see FIG. 3). This waveguide feed arrangement is in particular the most practical for Ku-band and Ka band applications since it is compact. In addition, this waveguide feed arrangement ensures low loss power transmission.

The beam former 306 as depicted in FIG. 4 has a co-axial cable 310 feeding the primary power combiner/splitter 308 (e.g., primary waveguide 308) at its centre. The primary waveguide 308 is coupled to a row of phase shifters 206 via broad wall slots 312 that are spaced roughly at half guided-wavelengths along the length of the primary waveguide 308. The spacing is not important, since the phase shifters 206 can be used to correct any phase differences, therefore it can be adjusted to match the widths of the secondary waveguides 304 (e.g., secondary power combiners/splitters 304) (see FIG. 7). The phase shifters 206 shown here are slotline phase shifters 206 where the slot gaps are loaded with a voltage tunable ferroelectric material. In the preferred embodiment, the voltage tunable ferroelectric material is made and sold under the name of Parascan™ material by Paratek Microwave, Inc. A bias voltage applied across the slotline gap is used to control the dielectric constant of the voltage tunable material, and hence the velocity of propagation in the slotline. The phase shifters 206 are designed with enough length to vary at least one wavelength in electrical length over the possible bias voltage range, thereby creating 360° of phase shift. The slotline gap width can be varied along its length, to create a non-uniform loaded slotline. This technique, which is done to allow a low biasing voltage to be used without increasing metallic current losses, is described in greater detail in U.S. patent application Ser. No. 10/199,724 entitled "A Tunable Electromagnetic Transmission Structure for Effecting Coupling of Electromagnetic Signals" that was filed Aug. 19, 2002. The contents of this patent application are hereby incorporated by reference herein.

Figure 5:
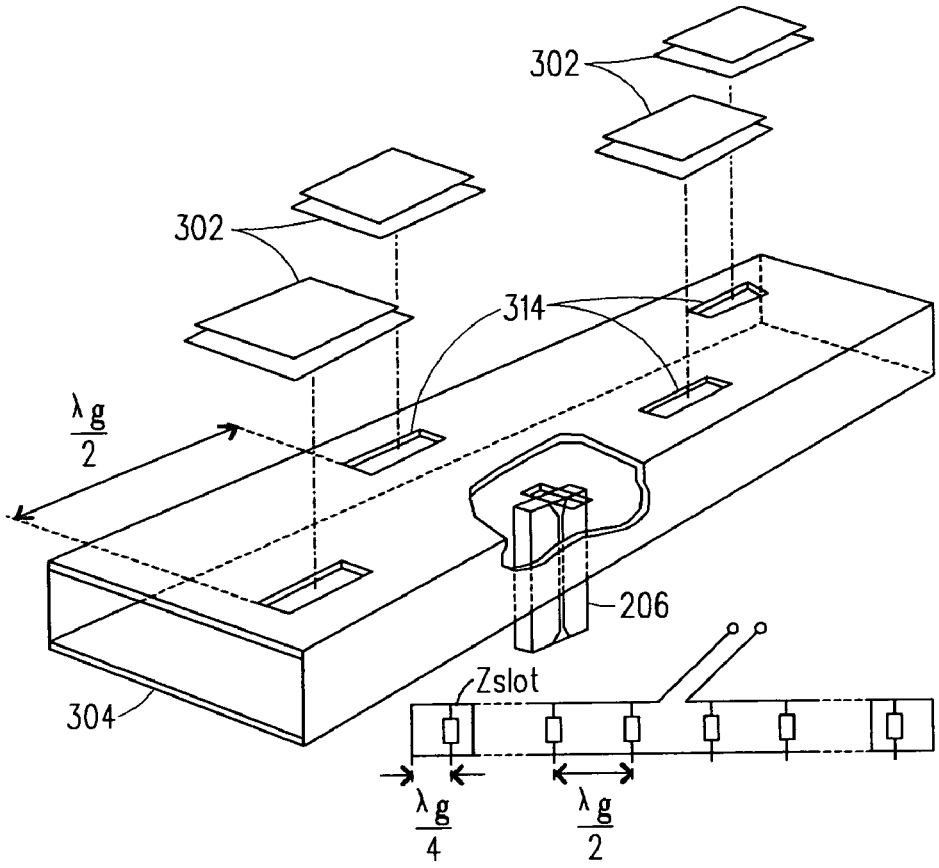
FIG. 5 is a diagram illustrating in greater detail the components of a secondary power combiner/splitter and the radiating elements that can be used within the multi-beam antenna system shown in FIG. 1.
Figure 6A:
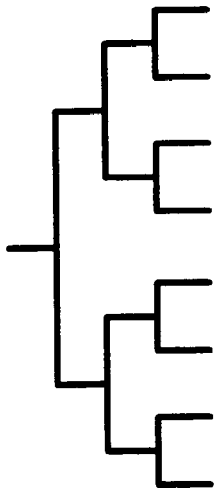
FIGS. 6A and 6B are diagrams that illustrate different feed structures that can be used in the primary power combiner/splitter shown in FIG. 4 and the secondary power combiners/splitters shown in FIG. 5.
Figure 6B:
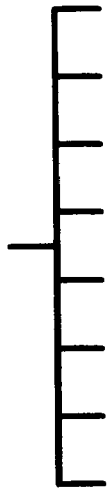
Figure 7:
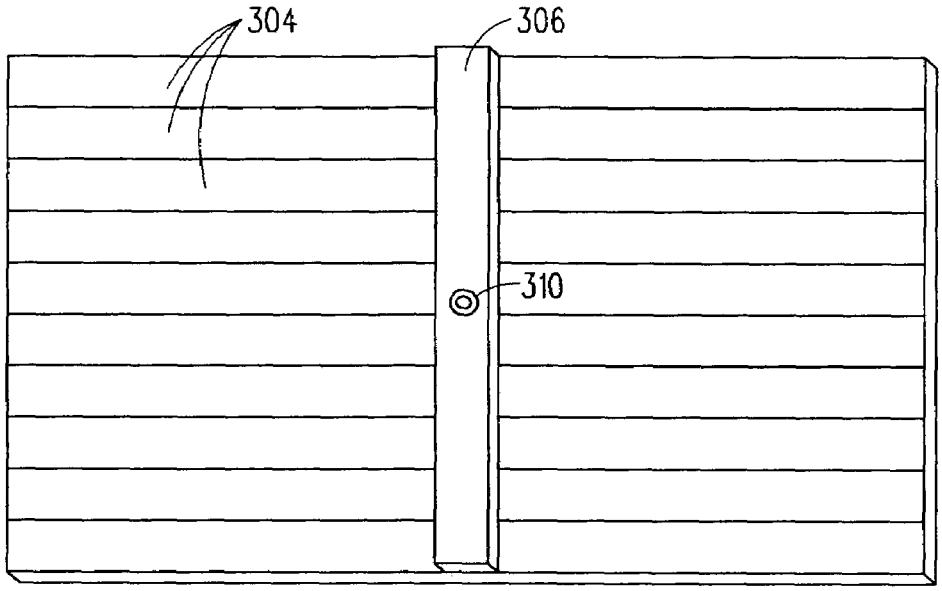
FIG. 7 is a diagram that illustrates how the beam former shown in FIG. 4 can be connected to the centre-series feed secondary power combiner/splitter shown in FIGS. 5 and 6B.

Each phase shifter 206 in the beam former 306 couples to the centre of a secondary waveguide 304 (e.g., secondary power combiner/splitter 304) as shown in FIG. 5. The secondary waveguide 304 couples to a column of the antenna elements 302 via broad wall slots 314 along its length. The slots 314 are spaced at half a guided wavelength apart, alternating on different sides of the waveguide's centre line. This ensures that the slots 314 are excited in series and in phase, since the broad wall current distribution flows away from the centre line of the secondary waveguide 304. The antenna elements 302 shown are stacked rectangular patches. These can be of any other shape (elliptical, polygon) as long as the radiated field exhibits polarization purity and power can be transmitted/received into/from space efficiently. Other types of antenna elements 302 can be used such as Vivaldi elements. Alternatively, the slots 314 themselves can be used as radiating elements 302. FIG. 7 is another diagram that illustrates how the beam former 306 can be connected to multiple centre-series feed secondary power combiners/splitters 304.

Referring to FIG. 8, there is a diagram that illustrates one way to package the multi-beam antenna system 100 shown in FIG. 1. The multi-beam antenna system 100 scans 1-D beam(s) 112 (narrow in azimuth with scanning and narrow in elevation with fixed cosecant squared null fill) anywhere within 360 degrees. The package shown is a truncated pyramid where each face or aperture 110 contains individual transmit and receive arrays. All of the components both RF elements (dividers, combiners, switches, phase shifters, amplifiers . . . ) and control elements (power supply . . . ) are contained within the package.

One embodiment of the multi-beam antenna system 100 may have the following capabilities shown in TABLE #1:

TABLE #1

| | Transmit | Receive |
|---|---|---|
| Frequency | 14.7–14.9 GHz | 15.1–15.3 GHz |
| Polarization | RHCP | LHCP |
| Beam Steering | 360 degree Azimuth (fixed beam in Elevation) each single panel providing +/– 45 degree azimuth scan | |
| Beamwidth Azimuth half-power | 5 degree Az | |
| Beamwidth Elevation half-power | 5 degree El--shaped with cosecant squared null fill in the up direction | |
| Beam scan/switching time | <10 ms (based on 20 mrad/sec tracking requirement) | |
| Maximum incoming power | 20 W | 20 W |
| Antenna gain | 24 dBi | 24 dBi |
| Antenna EIRP | 37 dBW per beam | — |
| Front-to-Back ration (F/B) | >20 dB | >20 dB |
| Return Loss | <–14 dB (1.5:1 VSWR) | <–14 dB (1.5:1 VSWR) |
| Impedance | 50 Ω | 50 Ω |
| Polarity discrimination | >20 dB | |
| Antenna Size | ~36" × 36" footprint by ~16" high | |

Figure 9B:
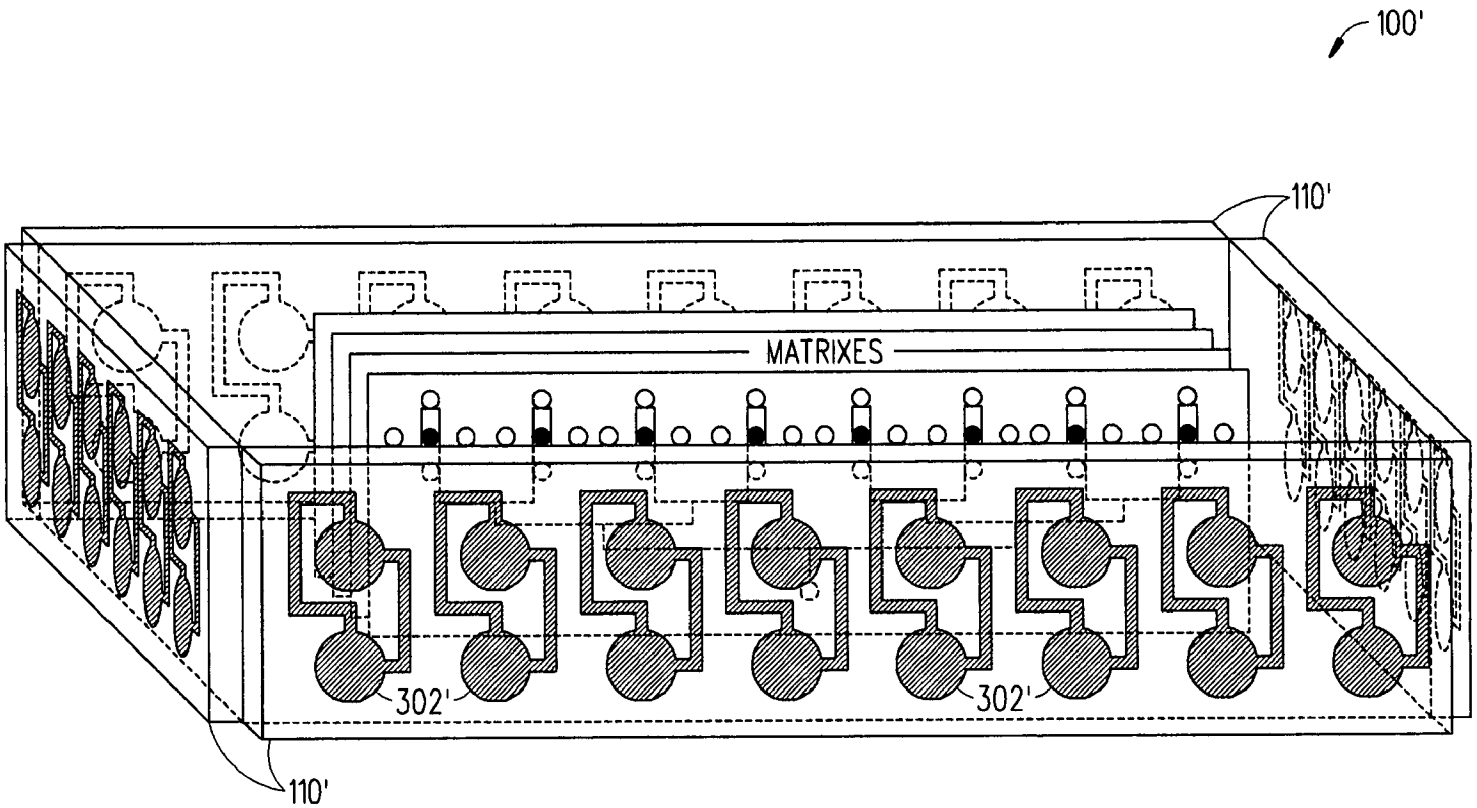
Figure 10:
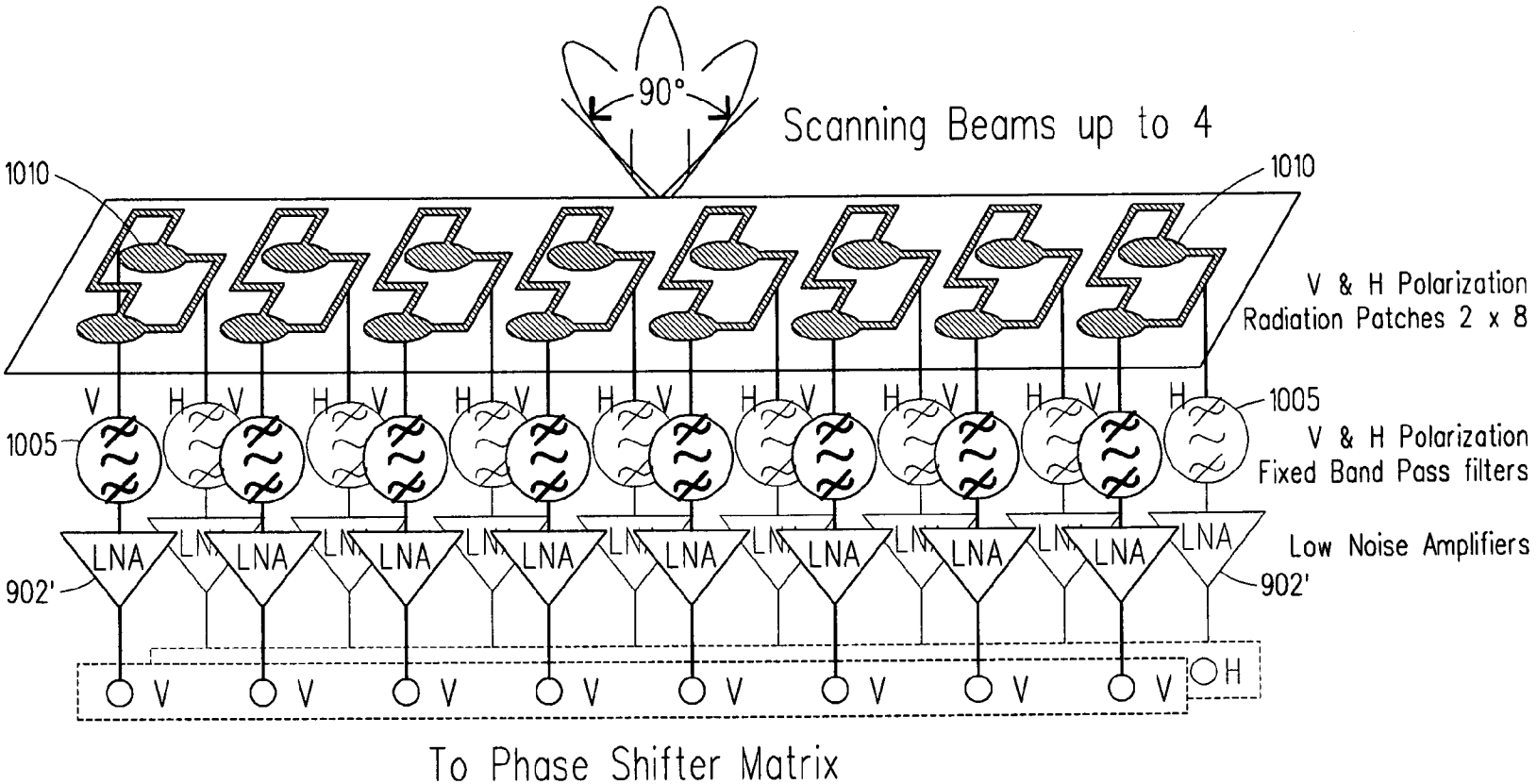
FIG. 10 is a diagram of one of the four radiation element array panels used in the multi-beam antenna system shown in FIGS. 9A and 9B.
Figure 11:
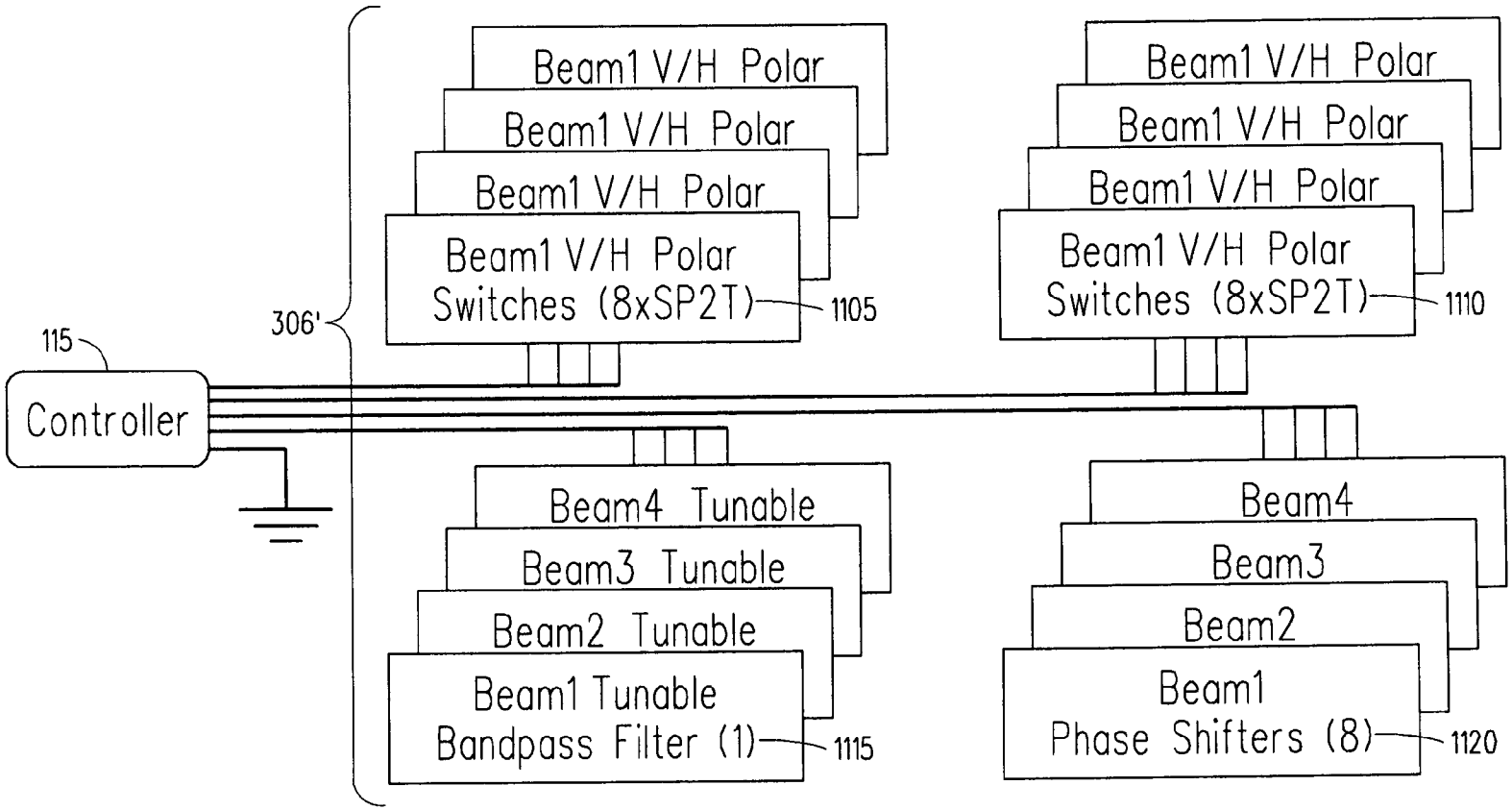
FIG. 11 is a diagram of a controller implemented within the multi-beam antenna system shown in FIGS. 9A and 9B.

Referring to FIGS. 9–11, there are several diagrams illustrating another embodiment of the multi-beam antenna system shown in FIG. 1.

In this embodiment, an active receive only multi-beam system 100' is described and shown whereby one or more of four array panels 110' is selected by a RF switching system 204'. As shown, the array panels 110' are connected via the RF switching system 204' to a 4-port phase shifter matrix 206' which includes 4 beam formers 306'. It should be appreciated that there could be M-phase shifter matrices 206' and M-beamformers 306'. Each beamformer 306' has 1 output port and N input ports, where N corresponds to the number of columns of antenna elements 302 in the corresponding array panel 110' (see FIG. 3). The M beamformers 306' allow the array panels 110' to simultaneously receive N radiation beams 112' (not shown). This is done by connecting input port n (n=1, 2, . . . , N) of each of the M beamformers 306' to an output of a low noise amplifier (LNA) 902 connected to column power combiner 304' number n (n=1, 2, . . . , N), which feeds column no. n of antenna elements 302' in the corresponding array panel 110'. M receivers 904 are connected to the M output ports of the M beamformers 306'. It should be appreciated that in another embodiment 4 parallel systems of M receivers 904 and M beamformers 306' can be connected to the 4 array panels 110' eliminating the need for the RF switching system 204. It should also be appreciated that a multi-beam transmit system can be constructed by reversing the direction of the LNAa 902 and connecting the beamformers 306' to transmitters (not shown) instead of to receivers 904. In yet another embodiment each side of the square of array panels 110' can be constructed to house 1 TX and 1 RX aperture 110' to form a full multi-beam transceiver system 100 that is capable of handling M simultaneous beams per aperture 110'. Thus, the main difference between the embodiment shown in FIG. 9A and that shown in FIG. 1, is that the number of simultaneous beams per antenna array aperture 110 has been increased from 1 to a multitude of M beams.

FIG. 9B shows a further addition/improvement to the antenna system 100' whereby each antenna array element 302' is dual polarized. FIG. 9B shows microstrip feed power combiners/splitters 304' feeding array columns consisting of 2 patch-type elements 302' (only two elements per column are shown for simplicity, but this can be increased/reduced to any arbitrary number). Since each of the dual polarized columns of antenna elements 302' now has two isolated ports representing two orthogonal polarizations, a second P-port phase shifter matrix connected to P receivers/transmitters can be used to feed the additional polarization. Thus, each array aperture is capable of handling M simultaneous beams of one polarization, and P simultaneous beams of the orthogonal polarization. FIG. 10 shows the position of the LNA's 902' connected to each column of array elements 1010. Each LNA 902' is connected via a band pass filter 1005 to the array column 1010 to protect the LNA 902' from out of band high power signals. FIG. 11 shows how the controller 115 of FIG. 2 will be connected to the different components of the beamformers 306'. Components may include V/H Polar Switches 1105, Panel Beam 1110, tunable bandpass filter 1115 and phase shifters. 1120.

The phase shifters 206 in the preferred embodiment may incorporate a voltage tunable ferroelectric material comprising Barium-Strontium Titanate, $Ba_xSr_{1-x}TiO_3$ (BSTO), where x can range from zero to one, or BSTO-composite ceramics. Examples of such BSTO composites include, but are not limited to: BSTO—MgO, BSTO—$MgAl_2O_4$, BSTO—$CaTiO_3$, BSTO—$MgTiO_3$, BSTO—$MgSrZrTiO_6$, and combinations thereof.

The following is a list of some of the patents which discuss different aspects and capabilities of the voltage tunable ferroelectric material all of which are incorporated herein by reference: U.S. Pat. Nos. 5,312,790; 5,427,988; 5,486,491; 5,635,434; 5,830,591; 5,846,893; 5,766,697; 5,693,429 and 5,635,433.

The phase shifters 206 can be configured as anyone of the phase shifters disclosed in U.S. Pat. Nos. 6,377,217; 6,621,377; 6,538,603; and 6,590,468. Or disclosed in U.S. patent application Ser. No. 09/644,019 (Aug. 22, 2000); Ser. No. 09/838,483 (Apr. 19, 2001); Ser. No. 10/097,319 (Mar. 14, 2002); Ser. No. 09/931,503 (Aug. 16, 2001); and Ser. No. 10/226,746 (Aug. 27, 2002). The contents of these patents and patent applications are hereby incorporated by reference herein.

The multi-beam antenna system 100 enhances the spatial and frequency agility of communication networks—at the antenna and the receiver system. Further, the multi-beam antenna system 100 can be used in mobile ad-hoc networks.

While the present invention has been described in terms of its preferred embodiments, it will be apparent to those skilled in the art that various changes can be made to the disclosed embodiments without departing from the scope of the invention as set forth in the following claims.

What is claimed is:

1. An apparatus, comprising:

a multibeam antenna including at least one pair of independent transmit and receive apertures, wherein each aperture includes:

a beam former including a primary waveguide and a plurality of phase shifters; and at least one secondary waveguide each of which is connected to one of the phase shifters and to at least one antenna element.

2. The apparatus of claim 1, wherein each aperture further includes a plurality of rows and a plurality of columns of radiating elements.

3. The apparatus of claim 2, wherein said plurality of radiating elements in each of said column are connected together via microwave transmission lines in a column secondary power splitter for said receive aperture or a column secondary power combiner in said transmit aperture.

4. The apparatus of claim 3, wherein said secondary power splitter/combiner is connected to said beam former to enable the steering of a radiation beam in one dimension.

5. The apparatus of claim 4, wherein said one dimension is the azimuth direction.

6. The apparatus of claim 1, wherein said beam former includes a primary power combiner/splitter which distributes and collects power in a serial manner to and from said phase shifters.

7. The apparatus of claim 6, wherein said beam former further includes a coaxial cable feeding the primary power combiner/splitter.

8. The apparatus of claim 1, wherein said primary waveguide is coupled to said phase shifters via broad wall slots that are spaced along the length of the primary waveguide.

9. The apparatus of claim 1, wherein said phase shifters are slotline phase shifters.

10. The apparatus of claim 9, wherein slot gaps in said slotline phase shifters are loaded with a voltage tunable ferroelectric material.

11. The apparatus of claim 10, wherein said voltage tunable ferroelectric material comprises $Ba_xSr_{1-x}TiO_3$ (BSTO), where x can range from zero to one.

12. The apparatus of claim 10, wherein said voltage tunable ferroelectric material comprises BSTO-composite ceramics.

13. The apparatus of claim 10, wherein said slot gaps width are capable of being varied along its length to provide for a non-uniform loaded slotline.

14. A method comprising:

providing a multi-beam antenna system;

controlling said multi-beam antenna system to enable transmission of at least one transmit beam and to enable reception of at least one receive beam, wherein said multi-beam antenna system includes:

at least one pair of independent transmit and receive apertures wherein each aperture includes:

a beam former that includes a primary waveguide and a plurality of phase shifters; and at least one secondary waveguide each of which is connected to one of the phase shifters and to at least one antenna element.

15. The method of claim 14, wherein each aperture further includes a plurality of rows and a plurality of columns of radiating elements.

16. The method of claim 15, wherein said plurality of radiating elements in each of said column are connected together via microwave transmission lines in a column secondary power splitter for said receive aperture and a column secondary power combiner in said transit aperture.

17. The method of claim 16, further comprising steering a radiation beam in one dimension via said secondary power splitter/combiner connected to said beam former.

18. The method of claim 17, wherein said one dimension is the azimuth direction.

19. The apparatus of claim 14, further comprising collecting and distributing power in a serial manner to and from said phase shifters by a primary power combiner/splitter in said beam former.

20. The method of claim 19, further comprising feeding the primary power combiner/splitter of said beam former with a coaxial cable.

21. The method of claim 14, wherein said primary waveguide is coupled to said phase shifters via broad wall slots that are spaced along the length of the primary waveguide.

22. The method of claim 14, wherein said phase shifters are slotline phase shifters.

23. The method of claim 22, wherein slot gaps in said slotline phase shifters are loaded with a voltage tunable ferroelectric material.

24. An article comprising a storage medium having stored thereon instructions, that, when executed by a computing platform controls a multi-beam antenna system thereby enabling transmission of at least one transmit beam and reception of at least one receive beam, wherein said multi-beam antenna system includes:

at least one pair of independent transmit and receive apertures where each aperture includes:

a beam former that includes a primary waveguide and a plurality of phase shifters; and at least one secondary waveguide each of which is connected to one of the phase shifters and to at least one antenna element.

25. The article of claim 24, wherein each aperture further includes a plurality of rows and a plurality of columns of radiating elements.

26. The article of claim 24, wherein said primary waveguide is coupled to said phase shifters via broad wall slots that are spaced along the length of the primary waveguide.

27. The article of claim 24, wherein said phase shifters are slotline phase shifters.

28. The article of claim 27, wherein slot gaps in said slotline phase shifters are loaded with a voltage tunable ferroelectric material.

* * * * *